US005880648A

United States Patent [19]

Aves et al.

[11] Patent Number: 5,880,648

[45] Date of Patent: Mar. 9, 1999

[54] N-WAY RF POWER COMBINER/DIVIDER

[75] Inventors: Donald Aves, Englishtown; Stephen J. Kolvek, Ridgewood, both of N.J.

[73] Assignee: MYAT, Inc., Norwood, N.J.

[21] Appl. No.: 840,491

[22] Filed: Apr. 21, 1997

[51] Int. Cl.[6] ..... H01P 5/12

[52] U.S. Cl. ..... 333/127; 333/136

[58] Field of Search ..... 333/123, 127, 333/136

[56] References Cited

U.S. PATENT DOCUMENTS

| | | | |
|---|---|---|---|
| 3,747,026 | 7/1973 | Covill | 333/6 |
| 3,904,990 | 9/1975 | LaRosa | 333/9 |
| 4,092,616 | 5/1978 | Osterwalder | 333/6 |
| 4,163,955 | 8/1979 | Iden et al. | 333/127 |
| 4,254,386 | 3/1981 | Nemit et al. | 333/128 |
| 4,263,559 | 4/1981 | Ho | 330/53 |
| 4,263,568 | 4/1981 | Nemit | 333/127 |
| 4,328,471 | 5/1982 | Quine | 333/128 |
| 4,335,347 | 6/1982 | Heaviside | 323/328 |
| 4,365,215 | 12/1982 | Landry | 333/127 |
| 4,369,415 | 1/1983 | Schwarzmann | 333/127 |
| 4,401,955 | 8/1983 | Yorinks et al. | 333/127 |
| 4,463,326 | 7/1984 | Hom | 333/128 |
| 4,543,545 | 9/1985 | Craine et al. | 333/128 |
| 4,553,266 | 11/1985 | Bates et al. | 455/327 |
| 4,590,446 | 5/1986 | Hsu et al. | 333/125 |
| 4,644,301 | 2/1987 | Hecht | 333/101 |
| 4,652,880 | 3/1987 | Moeller et al. | 342/373 |
| 4,656,434 | 4/1987 | Selin | 330/84 |
| 4,684,874 | 8/1987 | Swift et al. | 333/125 |
| 4,693,694 | 9/1987 | Seki | 446/197 |
| 4,769,618 | 9/1988 | Parish et al. | 330/27 |
| 4,835,496 | 5/1989 | Schellenberg et al. | 333/128 |
| 4,875,024 | 10/1989 | Roberts | 333/127 |
| 4,916,410 | 4/1990 | Littlefield | 330/295 |
| 4,926,145 | 5/1990 | Flam et al. | 333/125 |
| 5,017,886 | 5/1991 | Geller | 330/277 |
| 5,021,755 | 6/1991 | Gustafson | 333/128 |
| 5,055,798 | 10/1991 | Heinselmann | 330/295 |
| 5,079,527 | 1/1992 | Goldfarb | 333/127 |
| 5,083,094 | 1/1992 | Forsberf | 330/124 R |
| 5,111,166 | 5/1992 | Plonka et al. | 333/128 |
| 5,121,084 | 6/1992 | Anderson | 330/295 |
| 5,136,256 | 8/1992 | Salzberg | 330/53 |
| 5,150,084 | 9/1992 | Asa et al. | 333/128 |
| 5,164,689 | 11/1992 | Plonak | 333/128 |
| 5,187,447 | 2/1993 | Tsai | 330/124 R |
| 5,206,604 | 4/1993 | Vaninetti | 330/124 R |
| 5,206,611 | 4/1993 | Russell | 333/127 |
| 5,223,809 | 6/1993 | Myer . | |
| 5,256,987 | 10/1993 | Kibayashi et al. | 330/295 |
| 5,283,540 | 2/1994 | Myer | 333/127 |
| 5,304,943 | 4/1994 | Koontz | 330/51 |
| 5,313,174 | 5/1994 | Edwards | 333/109 |
| 5,329,248 | 7/1994 | Izadia | 330/295 |
| 5,389,890 | 2/1995 | Burrage | 330/124 R |
| 5,410,281 | 4/1995 | Blum | 333/127 |
| 5,445,546 | 8/1995 | Nakamura | 440/75 |
| 5,543,751 | 8/1996 | Stedman et al. | 330/124 D |
| 5,543,762 | 8/1996 | Sigmon | 333/128 |
| 5,561,395 | 10/1996 | Melton et al. | 330/2 |
| 5,576,671 | 11/1996 | Agar, Jr. et al. | 333/128 |

*Primary Examiner*—Paul Gensler

*Attorney, Agent, or Firm*—Milde, Hoffberg & MacKlin, LLP

[57] ABSTRACT

A high power Gysel multinode power network for an RF signal, having a plurality of RF ports, a plurality of RF isolation loads, each load being connected through a coaxial transmission line to a respective RF port, a combined port, comprising a first hub having a plurality of first radiating arms, each radiating arm comprising a coaxial transmission line extending to one of said RF ports, a node, comprising a second hub having a plurality of second radiating arms, each radiating arm comprising a coaxial transmission line extending to one of said RF isolation loads; and a common heat sink for dissipating heat from said plurality of RF isolation loads. The network is formed such that a normalized phase difference of the RF signal at a design frequency through said coaxial transmission line between each of said RF ports and said combined port is approximately equal to zero with respect to a portion of the RF signal traveling through said transmission line between each of said RF ports and a respective RF isolation load, through said transmission line between each of said RF isolation loads and said node, and through all other paths between said node and said combined port.

27 Claims, 10 Drawing Sheets

N-WAY RF POWER COMBINER/DIVIDER

FIELD OF THE INVENTION

The present invention relates to the field of high power radio frequency power combiners, and more particularly to an N-way radio frequency power combiner having a common load heat sink.

BACKGROUND OF THE INVENTION

The N-way power combiner/divider according to the invention is a solution to high power coaxial combining or dividing. This new design has many improvements over other combining techniques. The invention is based on a circuit design by Ulrich H. Gysel of the Stanford Research Institute and was presented to the IEEE in 1975. Ulrich H. Gysel, A New N-Way Power Divider/Combiner Suitable for High Power Applications, IEEE-MTTS-5, International Symposium Digest, pg. 116, 1975. The Gysel design, referred to as a Gysel Network, is, in turn, an improvement to the N-Way combiner/divider devised by Wilkinson. E. J. Wilkinson, An N-Way Hybrid Power Divider, IRE Trans. on Microwave Theory and Techniques, Vol. MTT-8, pp. 116–118 (January 1960). The improvements made by Gysel include: external isolation loads, easily realizable geometry and monitoring capabilities at the input ports. The original Wilkinson design was only applied to strip line systems. Years later, Harris Allied Broadcast Division incorporated the Gysel Network to a coaxial application in their Platinum™ Series FM Transmitter (trade mark of Harris Corporation). This solid state modular transmitter combined power modules to form a 10 kW output using the Gysel Network.

While the Gysel network is conceptually simple, implementing efficient high power combiners with coaxial transmission lines has remained difficult. Lower power systems, on the other hand, have been implemented using strip-line techniques and employing planar substrates. These techniques, however, are somewhat difficult to apply to high power load levels.

U.S. Pat. No. 3,904,990, expressly incorporated herein by reference, provides an N-way power divider with remote isolating resistors. U.S. Pat. No. 4,365,215, expressly incorporated herein by reference, provides a high power coaxial power divider. U.S. Pat. No. 4,369,415, expressly incorporated herein by reference, provides a coaxial transmission power line divider. U.S. Pat. No. 4,656,434, expressly incorporated herein by reference, provides an RF power amplifier with load mismatch compensation. U.S. Pat. No. 4,875,024, expressly incorporated herein by reference, provides a low loss power splitter. U.S. Pat. No. 5,111,166, expressly incorporated herein by reference, provides an N-way power combiner having N reject loads and a common heat sink. U.S. Pat. No. 5,164,689, expressly incorporated herein by reference, provides an N-way power combiner/divider. U.S. Pat. No. 5,206,604, expressly incorporated herein by reference, provides a broadband high power amplifier having an N-way power combiner. U.S. Pat. No. 5,410,281, expressly incorporated herein by reference, provides a microwave high power combiner/divider. U.S. Pat. No. 5,543,762, expressly incorporated herein by reference, provides an N-way impedance transforming power divider/combiner.

The following patents are related to the present invention, and are each expressly incorporated herein by reference: U.S. Pat. Nos. 3,747,026; 4,092,616; 4,163,955; 4,254,386; 4,263,559; 4,263,568; 4,328,471; 4,335,347; 4,401,955; 4,463,326; 4,543,545; 4,553,266; 4,590,446; 4,644,301; 4,652,880; 4,684,874; 4,693,694; 4,769,618; 4,835,496; 4,916,410; 4,926,145; 5,017,886; 5,021,755; 5,055,798; 5,079,527; 5,083,094; 5,121,084; 5,136,256; 5,150,084; 5,187,447; 5,206,611; 5,223,809; 5,256,987; 5,283,540; 5,304,943; 5,313,174; 5,329,248; 5,389,890; 5,445,546; 5,543,751; 5,561,395; and 5,576,671.

SUMMARY OF THE INVENTION

There are many applications which require the combining of N-Way RF power to achieve a desired power level, and in some cases a degree of fault tolerance. The N-Way power combiner/divider according to the invention is based on a design known as the Gysel Power Combiner/Divider. This design is characterized by (1) low insertion loss, (2) high isolation between output ports, (3) matched conditions at all ports, (4) external high power load resistors and, (5) monitoring capabilities for imbalances at the input ports. The configuration according to the present invention has been used to successfully combine and divide RF power above 10 kilowatt level for each input.

The present invention is the first to apply the Gysel power combiner technology to coaxial transmission lines at power levels well above 10 kW, and provides many enhancements to the Gysel design. When used as a combiner, the N-way combiner/divider provides:

- Lower insertion loss than hybrid combining;
- Fault tolerant design;
- High isolation between input ports;
- Matched conditions at all ports;
- Input matching maintained even when one or more ports are removed or faulted;
- Input port imbalance monitoring capability;
- Combined load resistor heat sink;
- Load input monitoring for phase matching;
- Low resistance DC discharge path for static buildup on antennas and feed lines;
- Resistance to temperature change-induced performance degradation;
- Minimal footprint;
- Freedom from need for adjustments;
- No moving parts; and
- Simple installation.

The present invention achieves these results by providing a phase and impedance matched $\pi$-type hybrid symmetrical 180° combiner system with a plurality of RF inputs, each having an associated load, a common node and a common output. The plurality of loads are disposed within a common heat sink structure, capable of dissipating heat in excess of the power of a single RF input, yet need not be able to dissipate power from all of the inputs. Generally, these power combiners are used at specific frequencies in fixed applications, so that the phase matching need not generally be broadband. However, where the application requires broad-band operation, known techniques may be applied to increase bandwidth. The transmission lines between the various inputs, loads, output and node are thus tuned for the operating conditions, using known techniques.

This tuning process, for example, entails ensuring that the system is mechanically sound, and thus would not inherently leak significant amounts of radio frequency power due to mechanical configuration, and examining the apparatus for radio frequency emissions or leakage. Where such emissions or leaking is detected, the transmission line characteristics are altered by inserting or removing dielectric, such as Teflon, at the point of maximum emission, which generally corresponds to a point of impedance mismatch.

The present invention provides a mechanical design and packaging system incorporating the advantages of the Gysel network for high power applications, in a compact package. Typically, the device is provided in a star-configuration, with two radiating spoke patterns for the output hub and common node hub, respectively, and a set of interconnecting transmission lines which bridge between the output hub star and the common node hub star. There may be an odd or even number of inputs and loads. These interconnecting transmission lines are preferably disposed substantially perpendicular to the spokes, although this is not required. The interconnecting transmission lines have a coaxial connector at each spoke intersection. At the intersection of the interconnecting transmission lines with the output hub spokes, the RF inputs are supplied. The output hub extends away from the interconnecting transmission lines. At the intersection of the interconnecting transmission lines with the common hub spokes, are provided coaxial connectors which lead to the loads, which are physically disposed distant from the output along the axis of the interconnecting transmission lines. Advantageously, the loads are in close proximity, and thus the coaxial lines leading to the loads from the coaxial connectors converge. The common heat sink structure, including, for example, cooling fins, may be the same diameter of as the network itself. The loads are provided within a common heat sink structure, in close proximity to each other. The diameter of the system is therefore controlled by the diameter of the central portion of each hub, and the length of each spoke. The length is controlled by the length of the output connector, the length of each interconnecting transmission line, and the length of the common heat sink structure. The width of each hub and the distance between the common heat sink structure are generally small. This arrangement distances the common heat sink structure from the inputs and output. In contrast, prior art systems provided separate isolation loads, which were generally placed radially outward from the interconnecting transmission lines, causing the structure to have a larger footprint and providing a total heat dissipation capacity in excess of that required under operating conditions.

The system may be mounted such that the common heat sink is below the network, with the inputs and output extending from the top. A mechanical support may be provided to relieve mechanical stresses from the transmission line components.

According to the present design, the system may be provided as a modular system, accommodating a varying number of inputs. In this manner, any number over two inputs may be provided. In the case of a modular system, the hub need not be planar, and may have a helically staggered spoke arrangement, or the spokes may be irregularly spaced and/or angled.

Other objects and advantages of the present invention will become apparent from a review of the drawings and detailed description.

BRIEF DESCRIPTION OF THE DRAWINGS

The preferred embodiments of the invention will be explained by reference to the drawings, in which.

DESCRIPTION OF THE PREFERRED EMBODIMENTS

Figure 1:
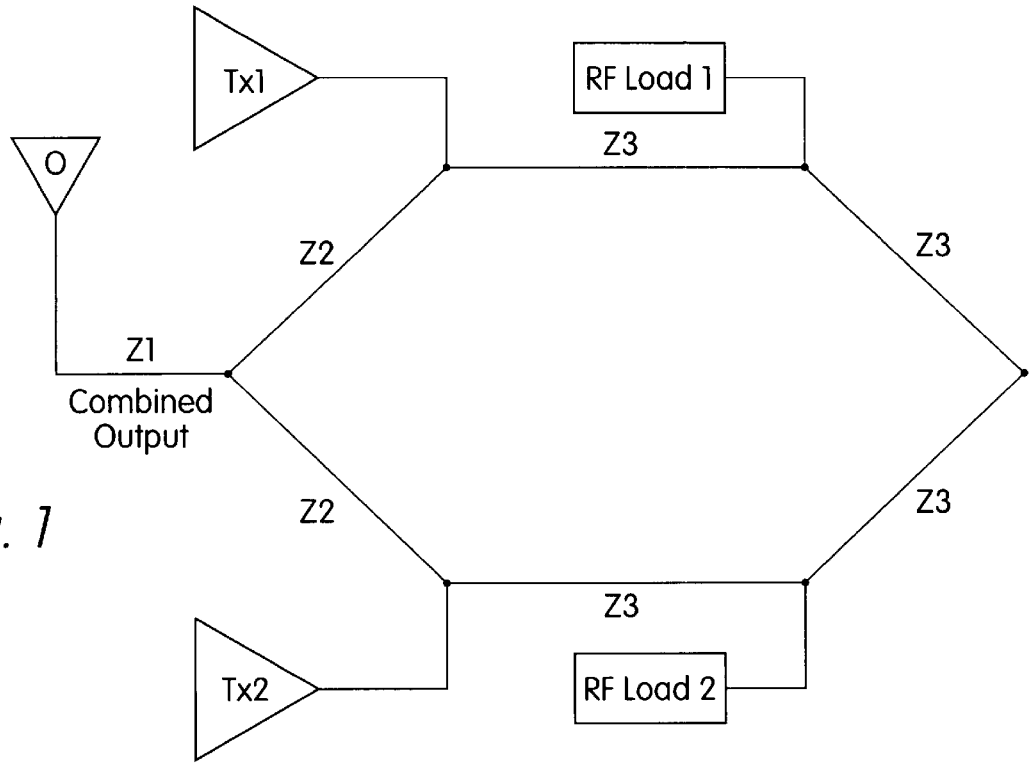
FIG. 1 is a schematic diagram of a 2-way Gysel network.

The preferred embodiments of the invention shall now be described with respect to the drawings, where identical reference numerals in the drawings indicate corresponding features.

The operation of the Gysel Network portion of the N-way combiner/divider according to the invention is simple to understand when a 2-Way Gysel Network schematic is analyzed, as shown in FIG. 1. All of the transmission line sections of the schematic are one quarter-wave in length. This simple 2-Way combiner schematic is a symmetrical 180° hybrid (π-type). The transmitters and output line, or load, are assumed to be 50 Ohm devices, however, any input and output impedance is possible. In this case, the first requirement is a 50 Ohm impedance at the output of the combiner Z1 and at the input ports. The impedance Z2 is a quarter-wave transformer which must match the 50 Ohm inputs to the 50 Ohm output impedance. The remaining quarter-wave line sections all have an impedance equal to 50 Ohms, i.e. Z3. The quarter-wave line sections are often replaced by odd-quarter-wave length line sections which would have no affect on the Gysel Network performance. Odd-quarter-wave line sections are normally applied when the length of the quarter-wave, for a given frequency, is too small to realize the mechanical requirements of a needed transmission line size. Thus, ¾, ⁵⁄₄, ⁷⁄₄, etc. wave length sections may be employed.

When equal voltages are supplied by the transmitters and arrive at the input port of this Gysel circuit in phase, the sum of both signals will be delivered to the output. There are three explanations for this:

(1) The electrical distance from each input port to the output port is equal, whether the power flows:

(a) through the short path along Z2 (1 quarter-wave length, 90°), or (b) through the longer path, Z3+Z3+[(n−1) (Z3+Z3+Z2) /(n−1)] (5 quarter-wave lengths, 450°).

(2) The signal from one input arrives at a load port out of phase from the other input.

(3) The signal from one input arrives at the other input out of phase regardless of the path it takes; 180° or 360°, and vice versa. Inputs are thus isolated from each other.

Figure 2:
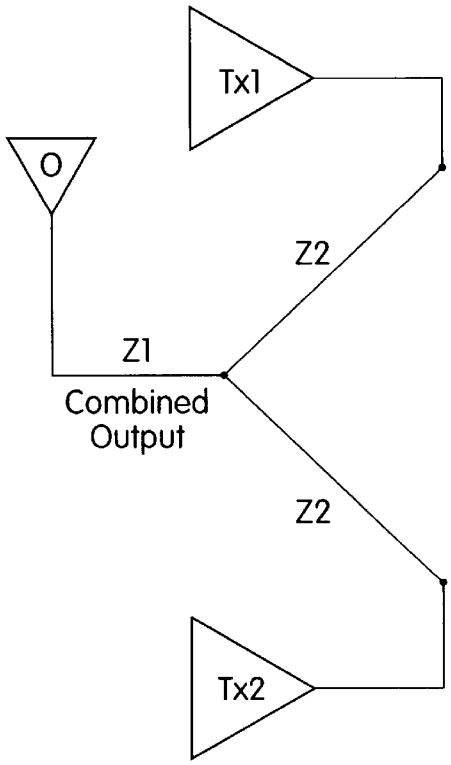
FIG. 2 is a simplified schematic diagram of a 2-way Gysel network with both inputs normally operational.

Under normal operating conditions, everything to the right of the inputs, all Z3 lines and the RF loads, are effectively "out of the circuit". The circuit can thus be simplified as shown in FIG. 2. The "out of the circuit" portion of this network comes into play only when a fault condition on the input port develops or when a transmitter is taken off line.

The input ports and the output port are under a matched condition especially when all transmitters are operating normally. When a transmitter Tx1, Tx2 is taken off line or a fault condition develops at an input port, the remaining input Tx2, Tx1 is still matched because of the inherent isolation of the network, e.g., the inputs are isolated from each other. The power from the normal operating transmitter is approximately evenly split between the output O and the isolation loads RF Load 1, RF Load 2. The operation of this 2-Way Gysel Network is very similar to a π/2 hybrid power divider circuit.

Figure 3:
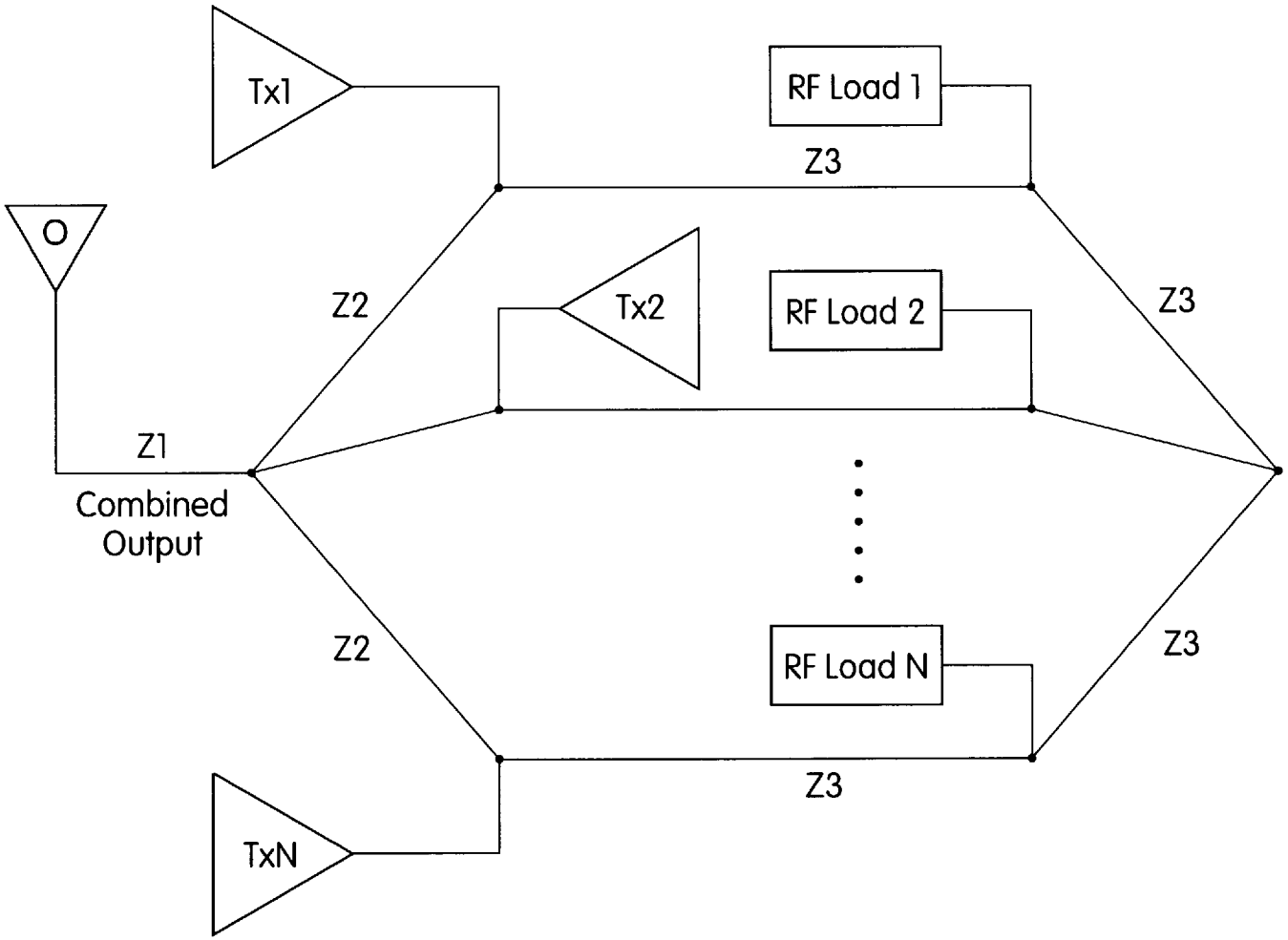
FIG. 3 is a schematic diagram of an N-way Gysel network.

This 2-Way Gysel Network can easily be expanded to 3, 4, 5, . . . , 17-Way by adding additional arms and adjusting the impedance Z2 to match the inputs to the output O, as shown in FIG. 3. It should be noted that all of the arms are identical in design and the power handling requirement is the same for each. This network can also be used as a power divider without any modifications.

A fault tolerance system can be achieved with this design. Suppose a 7-Way Gysel Network combiner is designed to combine seven solid state transmitter building blocks capable of 10 kW output each. If each transmitter is set for 5 kW output with an automatic gain control, an output level of 35 kW is achieved on the Gysel output port. When one transmitter is taken off-line for maintenance, or develops a fault, the remaining six transmitting outputs automatically increase to maintain the needed 35 kW power level at the output of the Gysel. In this condition, approximately 3 kW is dissipated in the isolation loads, i.e., six transmitters each produce about 6.3 kW. The system can be run indefinitely with up to two transmitters faulted while maintaining the desired 35 kW output. In this case, about 6 kW is dissipated by the isolation loads, and thus each of the five remaining transmitters each produce about 8.2 kW. The output power level will decrease only after three inputs are faulted or taken off-line at the same time, where the isolation loads dissipate about 9 kW, and the four remaining transmitters must each produce 11 kW to maintain the required power, in excess of their rated capacity.

Figure 6A:
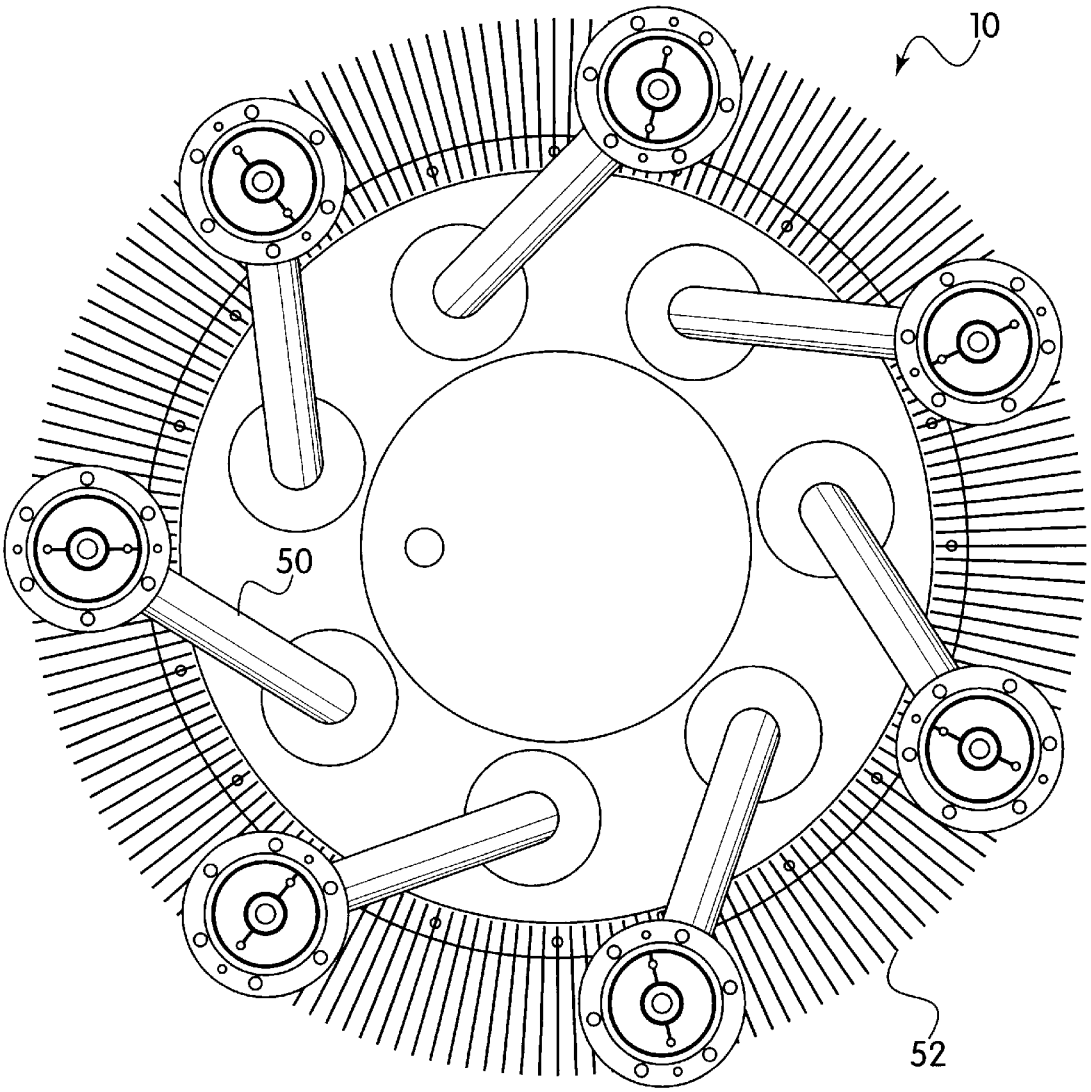
FIG. 6, comprised of FIG. 6*a* and FIG. 6*b,* is a bottom view and a side elevational view of a 7-way oil cooled RF load assembly according to the present invention.
Figure 6B:
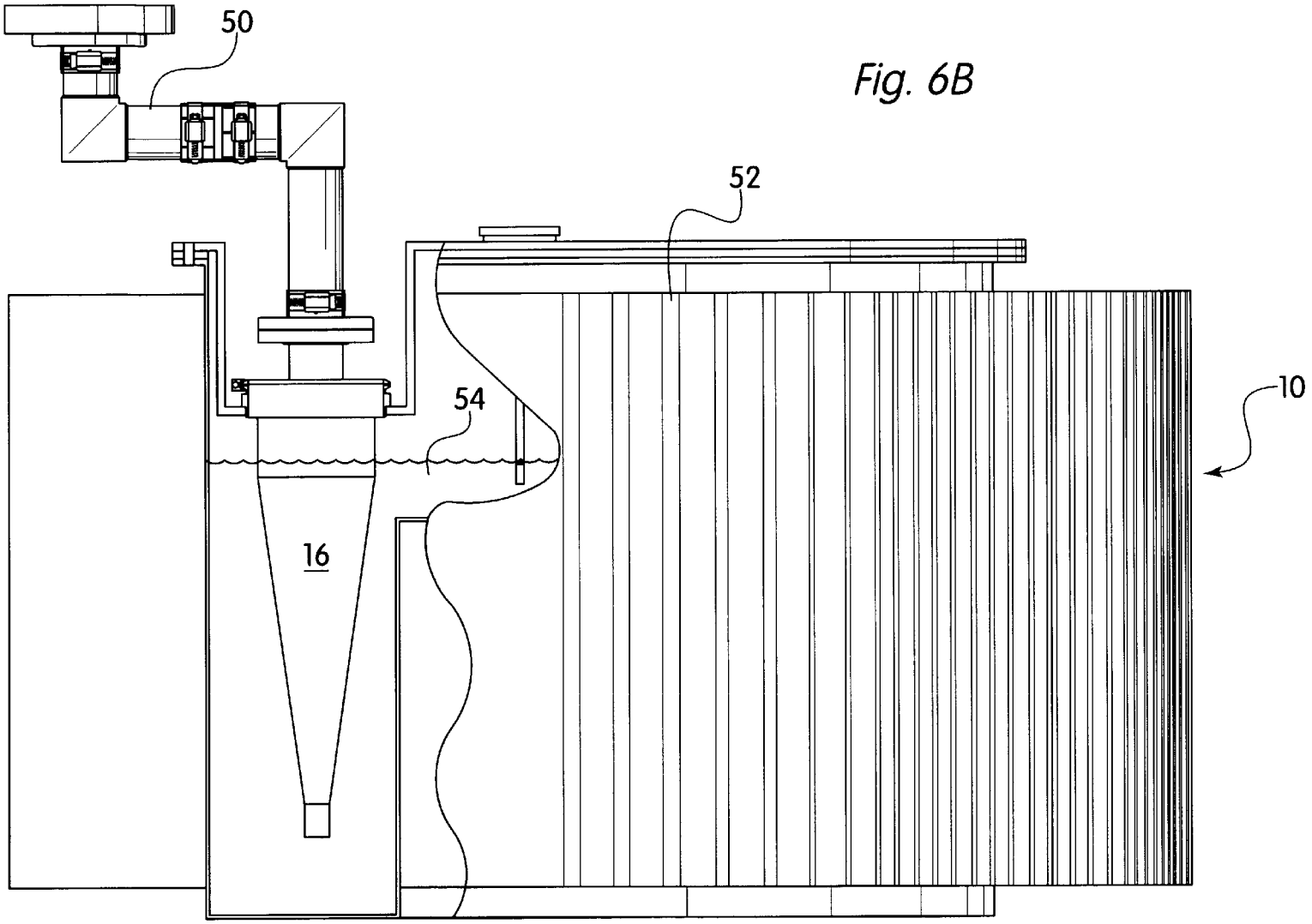
Figure 7A:
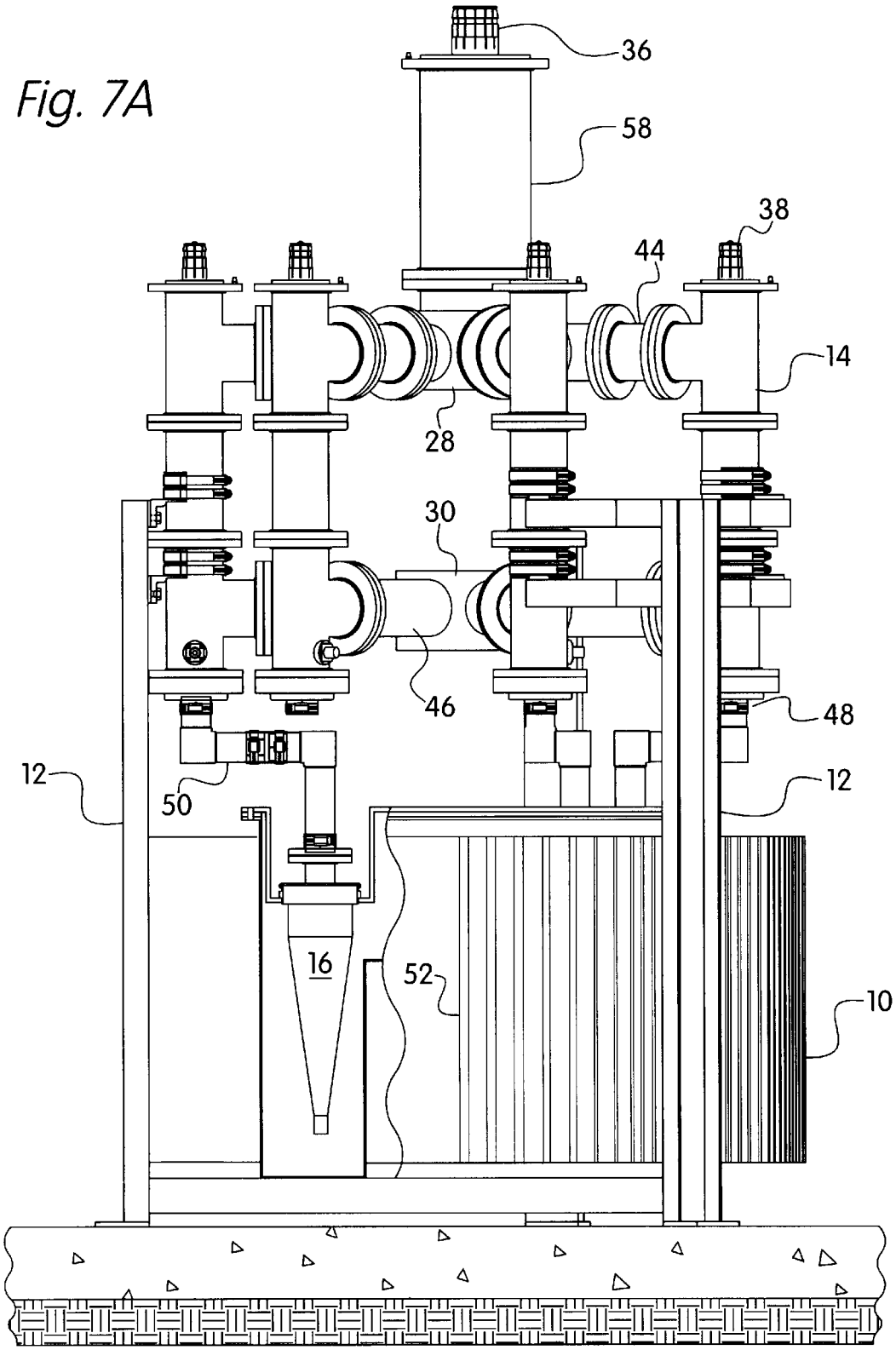
FIG. 7, comprised of FIG. 7*a* and FIG. 7*b,* is a typical configuration of an N-way power combiner/divider according to the present invention.

The N-way power combiner according to the present invention uses this Gysel technology, wherein all the isolation loads are combined in one location and employ a common heat sink structure 10, shown in FIGS. 6*a,* 6*b* and 7*a,* for the isolation loads. A common frame 12, shown in FIG. 7*a* is provided to support the coaxial transmission line structures 14 above the heat sink structure 10. As discussed above, while each isolation load 16, shown in partial cross section in FIG. 6*b,* must be able to dissipate about 3 kW, the maximum amount that the combined heat sink structure 10 must be able to dissipate is 9 kW, clearly less than the composite 21 kW dissipation for all seven of the isolation loads 16 together.

This system is a complete package requiring a minimal footprint, no special installation hardware and has been proven to be simple to install.

The system according to the present invention is scalable both in power handling capacity and in frequency range, and thus encompasses a full line of reliable, fault tolerant and more efficient, N-way radio frequency power combiners and dividers for various requirements.

The power/combiner system according to the invention can be used any time radio frequencies need to be combined or divided, especially at high power levels which require large diameter coaxial transmission lines. High power radio frequency combining and dividing is common in the terrestrial broadcasting of FM radio, VHF and UHF television, and nuclear engineering. The Gysel Network of this system can be configured, with coaxial transmission line, to combine or divide radio frequencies up to 1000 MHz and power levels up to 4.5 MW.

The required operating frequency and power levels determine the transmission line sizes and mechanical dimensions for the Gysel Network portion of the system.

The present invention is the first to apply the Gysel Network design to power levels exceeding 10 kW and transmission line sizes from ⅞" through 24" for standard and non-standard input and output impedances.

Figure 4:
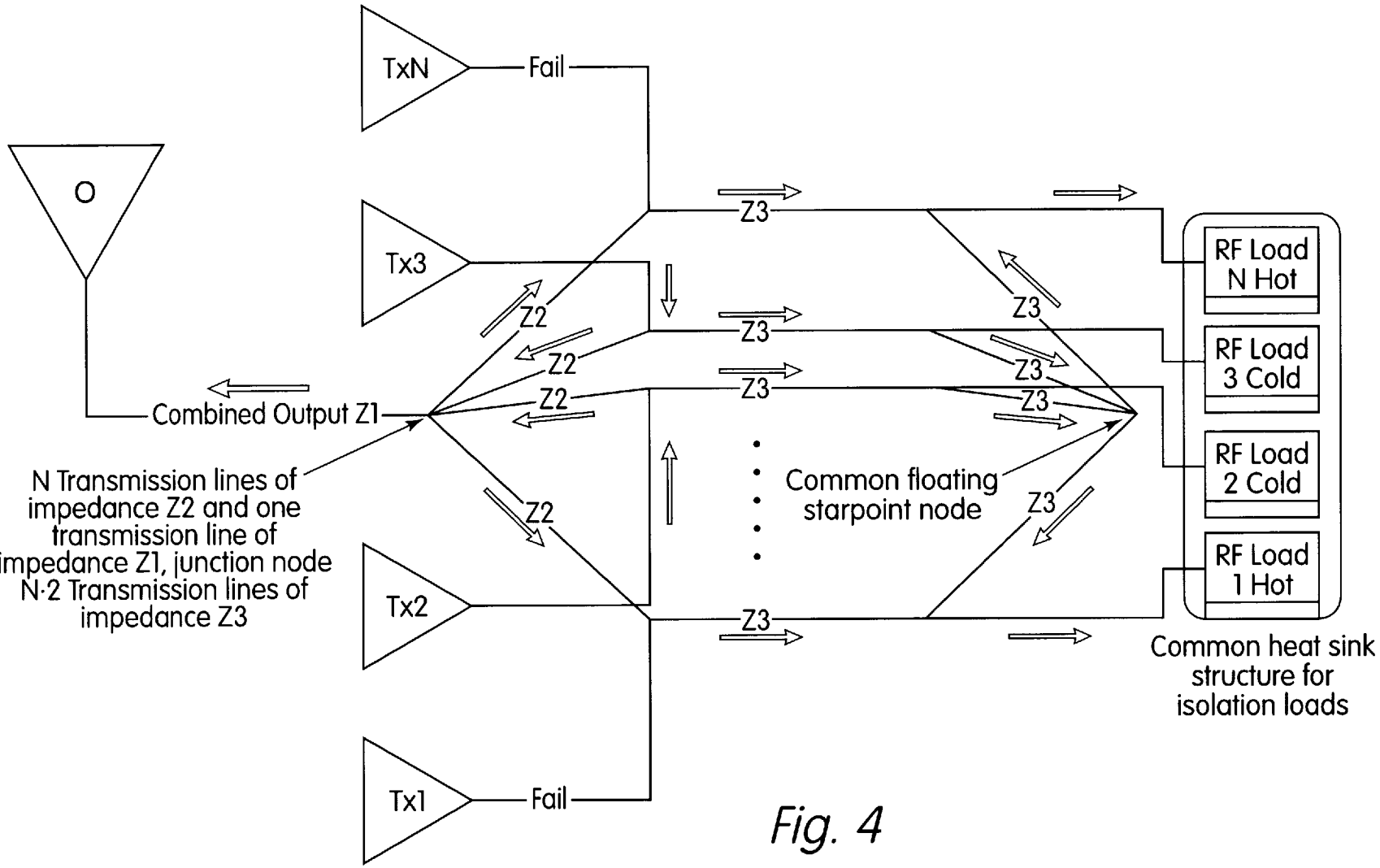
FIG. 4 is a schematic diagram of an N-way Gysel network showing power dissipation due to failure of two inputs.

As shown in FIG. 4, inputs 1 and N are faulted, while inputs 2 and 3 are operational. Power is supplied by inputs 2 and 3, which flows along two sets of paths bidirectionally from the input junction: toward the output junction, and toward the loads. Of the portion of power which is directed toward the isolation loads, a portion is dissipated in the isolation loads corresponding to the faulted inputs. These isolation loads allow output impedance matching over varying input conditions.

The present coaxial transmission line Gysel Network designs may also have a unique shape at two nodes 20, 22 of the network. The two nodes are indicated schematically in FIG. 4, along with power flow during the example fault condition discussed above.

The two identified nodes are star-burst shaped in appearance. There is a common point with N-Way connected transmission lines radiating from the central point. The radiating arms may be equally spaced about one plane. However, these radiating arms may also be disposed on different planes and/or not equally spaced. These alternate construction schemes may be used, for example, when there are space restrictions at the installation site or when a expandable system is desired. The interface port dimensions are normally supplied to meet E.I.A. standard RS-225 and/or Industry Standard connectors for flanged or unflanged lines.

Figure 5B:
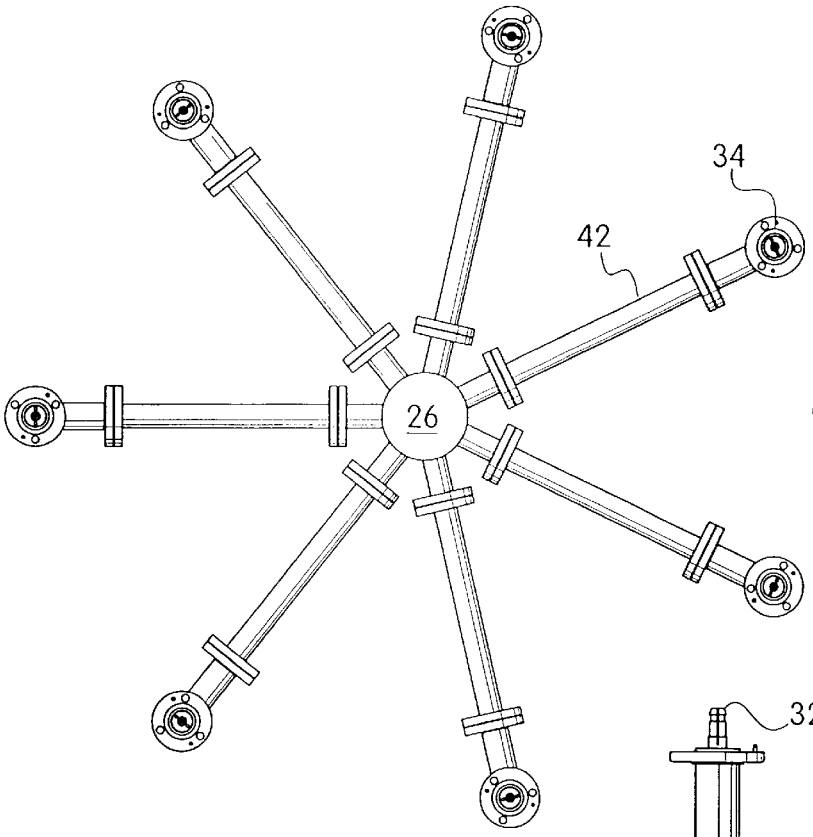
FIG. 5, comprised of FIG. 5*a,* FIG. 5*b,* FIG. 5*c* and FIG. 5*d,* are side elevation and bottom views of a first embodiment and top and side elevation of a second embodiment views, respectively, of 7-way combiners according to the present invention.
Figure 5A:
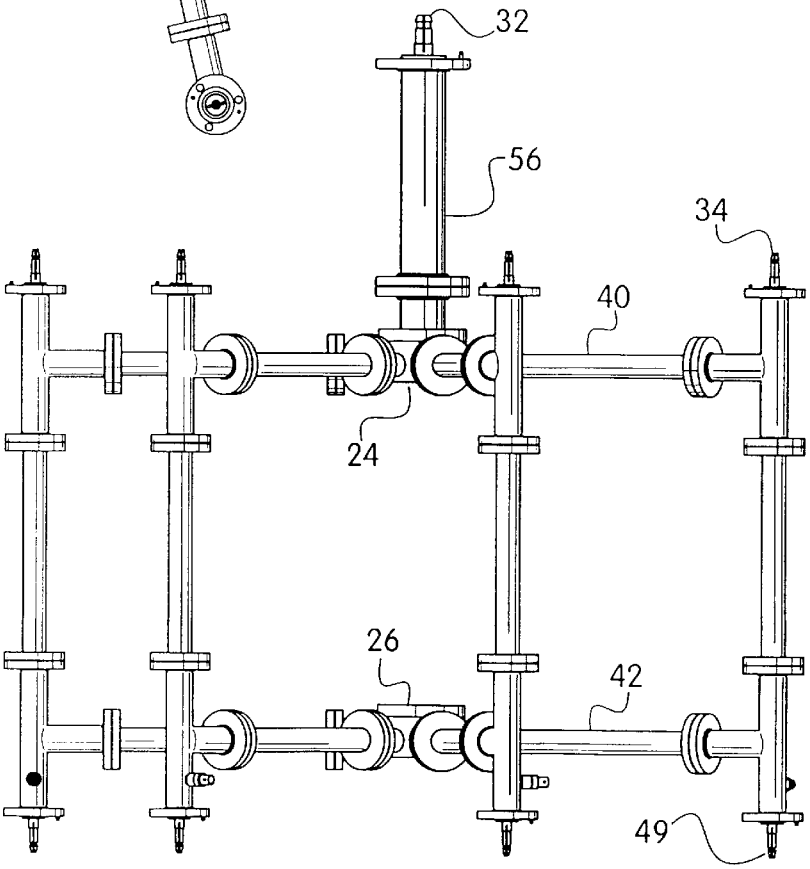
Figure 5C:
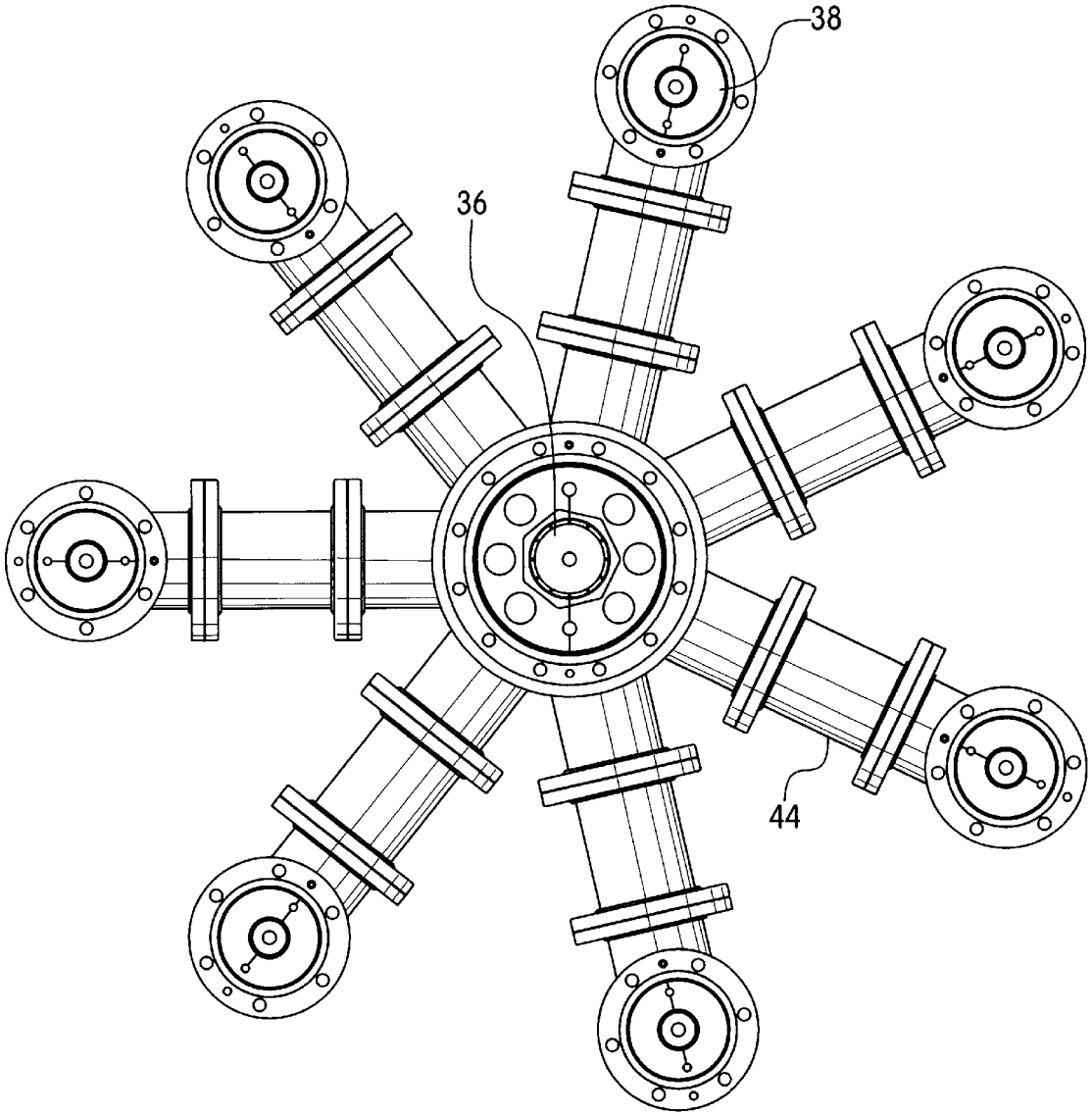

FIG. 5 shows two exemplary construction configurations which may be used in the Gysel N-Way combiner/divider which is incorporated into the system according to the invention. They include:

FIG. 5*a* 1⅝" 50 Ohm E.I.A. output 32;

FIG. 5*b* ⅞" 50 Ohm E.I.A. inputs 34;

FIG. 5*c* 3⅛" 50 Ohm E.I.A. inputs 38; and

Figure 5D:
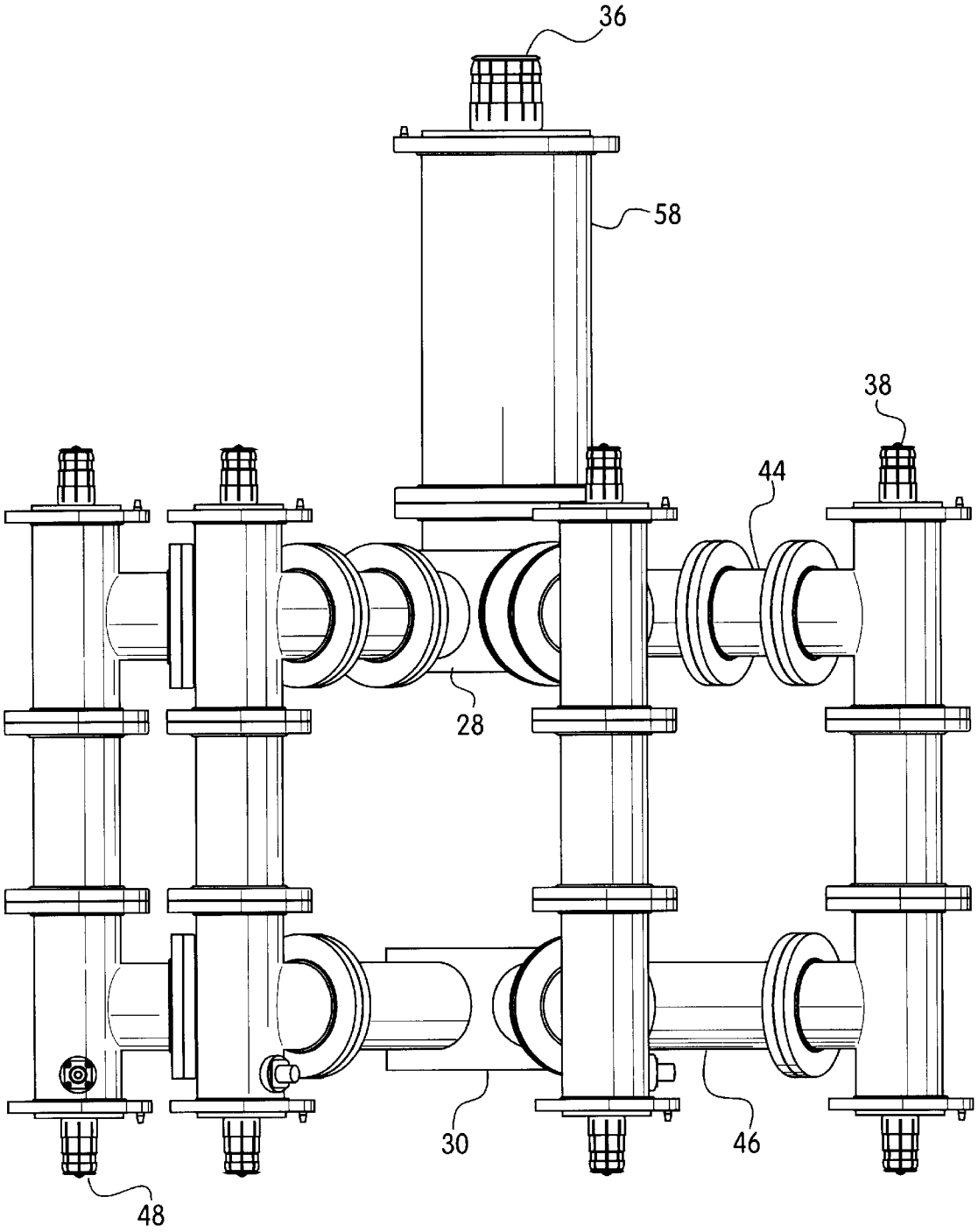

FIG. 5*d* 6⅛" 50 Ohm E.I.A. output 36.

In both the embodiment of FIGS. 5*a,* 5*b* and FIGS. 5*c,* 5*d,* the hubs 24, 26, 28, 30 have radiating arms 40, 42, 44, 46, which are coplanar and at regularly spaced angular intervals. These designs also provide coaxial transmission line segments between the input ports 34, 38 and the RF isolation load ports 49, 48 which are mutually parallel. In this design, therefore, the RF isolation load ports 49, 48, situate the RF isolation loads 16 at a distance dependent on the length of each radiating arm 42, 46. In order to form a more compact common heat sink structure, as shown in FIGS. 6*a,* 6*b,* the connection 50 between the RF isolation loads 16 and the RF isolation load ports 48 may converge, providing both impedance matching and a compact configuration. In turn, this compact configuration allows cooling fins 52 to extend to about the diameter of the matching network structure, e.g., about twice the length of a radiating arm.

As shown in FIG. 5, the common node hubs 26, 30, differ from the output node hubs 24, 28, in that the common node hubs 26, 30 have radiating arms only, while the output node hubs 24, 28 have an output coaxial transmission line section 56, 58, of impedance Z1 extending from the output node hubs 24, 28. This output coaxial transmission line section 56, 58, carries the full output power and may be of a larger size than the remaining transmission line segments of the system.

High power RF isolation loads are required for proper operation of the Gysel Network. For example, a Gysel 7-Way Power Combiner/Divider would require seven RF isolation loads. There are high power RF loads available from various vendors. The commonly available RF loads can be cooled by air, water, or oil. The physical space and interconnecting lines normally required for seven individual RF load assemblies, i.e., an RF isolation load and associated heat sink structure, is great; however, the system according to the invention provides a compact and efficient solution.

The present invention employs a common heat sink 10 for high power coaxial RF isolation loads 16. RF isolation loads 16 are required to combine or divide RF power regardless of the combiner/divider design. This new approach for the RF isolation loads 16 minimizes the area required for the needed RF isolation loads 16 and the interconnecting line sections 50. The N-Way RF load assemblies may be either oil or air cooled designs. FIG. 6 shows a 7-Way oil 54 cooled RF isolation load 16 assembly.

Figure 7B:
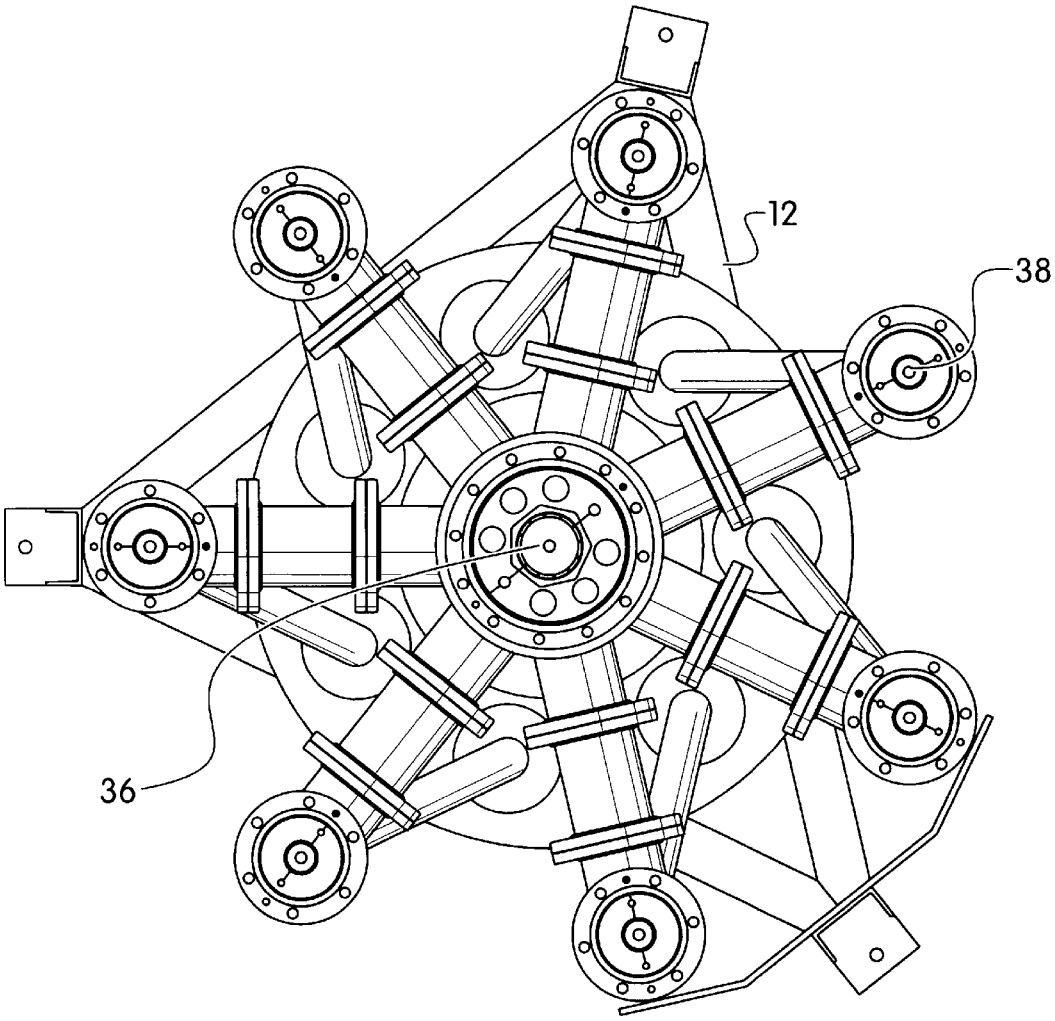

FIG. 7 shows a 7-Way Power Combiner/Divider according to the present invention which was constructed for combining seven 10 kW video solid state Channel 13 transmitters, each provided at an input port 38, to an output port 36.

It should be understood that the preferred embodiments and examples described herein are for illustrative purposes only and are not to be construed as limiting the scope of the present invention, which is properly delineated only in the appended claims.

What is claimed is:

1. A high power Gysel multinode power network for an RF signal, comprising:

(a) a plurality of RF ports;

(b) a plurality of RF isolation loads, each load being connected through a coaxial transmission line to a respective RF port;

(c) a combined port, comprising a first hub having a plurality of first radiating arms, each radiating arm comprising a coaxial transmission line extending to one of said RF ports;

(d) a node, comprising a second hub having a plurality of second radiating arms, each radiating arm comprising a coaxial transmission line extending to one of said RF isolation loads; and (e) a common heat sink for dissipating heat from said plurality of RF isolation loads, wherein said network is formed such that a normalized phase difference of the RF signal at a design frequency through said coaxial transmission line between each of said RF ports and said combined port is approximately equal to zero with respect to a portion of the RF signal traveling;

through said transmission line between each of said RF ports and a respective RF isolation load, through said transmission line between each of said RF isolation loads and said node, and through all other paths between said node and said combined port.

2. The high power Gysel multinode power network according to claim 1, wherein said RF ports each comprise a coaxial connector.

3. The high power Gysel multinode power network according to claim 1, wherein said RF isolation loads are each capable of dissipating at least 1 kW continuous.

4. The high power Gysel multinode power network according to claim 1, wherein said RF isolation loads are each capable of dissipating at least 5 kW continuous.

5. The high power Gysel multinode power network according to claim 1, wherein said RF isolation loads are each capable of dissipating at least 10 kW continuous.

6. The high power Gysel multinode power network according to claim 1, wherein said first hub comprises a planar structure.

7. The high power Gysel multinode power network according to claim 1, wherein said first hub comprises a plurality of radiating arms in differing planes.

8. The high power Gysel multinode power network according to claim 1, wherein said first hub comprises a plurality of radiating arms at regular angular intervals.

9. The high power Gysel multimode power network according to claim 1, wherein said first hub comprises a plurality of radiating arms at irregular angular intervals.

10. The high power Gysel multinode power network according to claim 1, wherein said common heat sink is capable of dissipating at least 5 kW continuous.

11. The high power Gysel multinode power network according to claim 1, wherein said common heat sink is capable of dissipating at least 10 kW continuous.

12. The high power Gysel multinode power network according to claim 1, wherein said RF isolation loads are each connected by a coaxial transmission line to a junction of a coaxial transmission line to a respective RF port and a coaxial transmission line extending to said node.

13. The high power Gysel multinode power network according to claim 1, having at least 5 RF ports.

14. The high power Gysel multinode power network according to claim 1, having at least 7 RF ports.

15. The high power Gysel multinode power network according to claim 1, wherein said radiating arms of said first hub are each disposed in parallel planes.

16. The high power Gysel multinode power network according to claim 1, wherein said radiating arms define a diameter, said common heat sink having a diameter less than said defined diameter.

17. The high power Gysel multinode power network according to claim 1, wherein said common heat sink is air cooled.

18. The high power Gysel multinode power network according to claim 1, wherein said common heat sink is water cooled.

19. The high power Gysel multinode power network according to claim 1, wherein said common heat sink is oil cooled.

20. The high power Gysel multinode power network according to claim 1, further comprising a supporting frame, disposed distal to said coaxial transmission lines between said RF isolation loads and a respective RF port with respect to said second hub.

21. The high power Gysel multinode power network according to claim 1, wherein each of said RF ports comprises a 50 Ohm ⅞" E.I.A. input.

22. The high power Gysel multinode power network according to claim 1, wherein each of said RF ports comprises a 50 Ohm 3⅛" E.I.A. input.

23. The high power Gysel multinode power network according to claim 1, wherein each of said RF ports comprises a 50 Ohm 1⅝" E.I.A. output.

24. The high power Gysel multinode power network according to claim 1, wherein each of said RF ports comprises a 50 Ohm 6⅛" E.I.A. output.

25. The high power Gysel multinode power network according to claim 1, wherein each of said radiating arms of said first hub are parallel to a corresponding one of said radiating arms of said second hub.

26. The high power Gysel multinode power network according to claim 1, wherein each of said coaxial transmission lines has a phase delay at said design frequency of about $\pi/4$.

27. The high power Gysel multinode power network according to claim 1, wherein at least one of said coaxial transmission lines is impedance matched by a process of measuring an impedance property and modifying a coaxial transmission line diameter to alter said impedance property.

* * * * *